US005524815A

United States Patent [19]

Sheffer

[11] Patent Number: 5,524,815

[45] Date of Patent: Jun. 11, 1996

[54] PLURAL-COMPARTMENT DISPLAY CARTON WITH LOCKING BOTTOM AND CENTER SUPPORT

[75] Inventor: Phil B. Sheffer, Thomasville, Pa.

[73] Assignee: Triangle Container Corporation, Philadelphia, Pa.

[21] Appl. No.: 528,101

[22] Filed: Sep. 14, 1995

[51] Int. Cl.[6] ..... B65D 5/486

[52] U.S. Cl. ..... 229/120.18; 229/120.03; 229/157; 229/185

[58] Field of Search ..... 229/120.03, 120.11, 229/120.18, 120.24, 156, 157, 164, 185

[56] References Cited

U.S. PATENT DOCUMENTS

| | | | |
|---|---|---|---|
| 2,175,600 | 10/1939 | Greco | 229/120.18 |
| 2,450,419 | 10/1948 | Cassidy et al. | 229/120.03 |
| 2,693,309 | 11/1954 | Giroux et al. | 229/120.03 |
| 2,747,785 | 5/1956 | Fink | 229/120.03 |
| 3,145,902 | 8/1964 | Nolen | 229/120.03 |
| 3,517,875 | 5/1968 | Wakefield | 229/117 |
| 4,541,560 | 9/1985 | Fischer | 229/120.18 |
| 4,585,159 | 4/1986 | Travis | 229/185 |
| 4,913,291 | 4/1990 | Schuster | 229/120.03 |
| 5,065,937 | 11/1991 | Ritter | 229/120.18 |
| 5,413,276 | 5/1995 | Sheffer | 229/120.03 |

*Primary Examiner*—Gary E. Elkins

*Attorney, Agent, or Firm*—Eckert Seamans Cherin & Mellott

[57] ABSTRACT

A reinforced display carton is cut from a single sheet of material and folded to form exterior wall panels, bottom flaps and an internal subdividing web, that can be collapsed flat for shipping. The bottom flaps lock together when the carton is erected into a rectilinear state, and engage with the subdividing web, which is reinforced by folded over panels. A barb shaped slotted tongue on one of the bottom flaps fits into a slot between the other bottom flaps to lock them, and straddles a lower edge of the internal web. The subdividing web is formed from an extension of a half-width rear panel folded at a rear glue joint with a second half-width rear panel, and is attached at a glue tab to the back side of the front panel. The web has upper and lower reinforcing panels folded up and down over one another and locked in the slot of the tongue. Access openings extend up to the top edge of the front wall on either side of the central web, and the central web reinforces the carton against vertical forces, e.g., due to stacking. The access openings can be closed by top flaps that fold over in a U-shaped configuration and are removable for use of the carton as a dispensing display.

15 Claims, 4 Drawing Sheets

PLURAL-COMPARTMENT DISPLAY CARTON WITH LOCKING BOTTOM AND CENTER SUPPORT

BACKGROUND OF THE INVENTION

1. Field of the Invention

The invention relates to packing and shipping cartons, and in particular concerns a plural-compartment carton formed from an integral flat piece of sheet material, and arranged with folds, glue joints and interlocking parts so as to erect into a reinforced and locked configuration. The canon has access openings in a front wall for compartments delineated by an internal partition. The partition has two panels doubled over a third panel attached between the front and rear walls. This three thickness partition is held by a slotted flap on one bottom panel or flap, that fits into a gap between the other bottom panels, thereby both locking the bottom in place and forming a central column that supports the carton, especially in the area weakened by the tear-out panels.

2. Prior Art

A two-compartment packing and shipping carton is advantageously used, for example, for packing complementary products. In the example of candy packaging, the two compartments can be used for comparable products with nuts and without nuts, respectively. Various other examples of alternative choice products are also possible. A known two-compartment container for shipping and display of alternative products comprises the combination of a separate cap-like top, which is relatively shallow, and a deep box-like bottom. At the packing line, the box-like bottom is filled with a product and the cap-like top is placed over the box-like: bottom for shipping or storage.

U.S. Pat. No. 5,413,276—Sheffer discloses an improved two-compartment container that is formed from an integral piece of sheet stock, including the bottom, side walls and top, as opposed to a separate box and cap or cover. The sheet stock can be corrugated paperboard or the like. Such a carton can be creased, cut, perforated or similarly arranged to define relatively foldable panels that when erected become the six sides of the canon. In Sheffer '276, in addition to panels for the, six sides, covering panels are provided to seal over access openings in the front wall, and a further panel defines an internal web that subdivides the carton laterally into two compartments.

Cartons of this type are customarily handled several times between manufacture and retail use, being built in stages by the carton manufacturer and packer, respectively, and then partly disassembled by the retailer for access to the product. For example, the carton manufacturer cuts out the sheet material for the canon and makes a limited number of folds and attachments such that the carton can remain collapsed flat. Erection and the remaining attachments are left for when the canon is packed and sealed for shipment. The manufacturer cuts out a flat blank and forms certain folds generally forming the carton into a collapsed tube.

Abutting edges are affixed by glue, staple or tape joints or seams, while still permitting the carton to be collapsed flat for stacking a number of canons for shipping to the packer in a compact state. The carton can be made into a simple rectilinear tube or a bifurcated tube, folded flat between diagonally opposite corners in the manner of a parallelogram, leaving the top and bottom flaps unjoined to the front, back and sides. This allows a number of the cartons to be stacked flat to conserve space when shipping the cartons while empty.

The packer erects the collapsed carton into a rectilinear shape by pressing the diagonally opposite comers toward one another, and affixes the bottom panels by appropriate joints. The carton is then filled with product and the top panels are likewise attached to thereby seal the carton. Assembly of the bottom flaps and/or top flaps may include overlapping and affixing the flaps in various configurations. Bottom or top flaps that are attached to opposite side walls (e.g., the front and rear side walls) can be overlapped and attached, or flaps attached to adjacent side walls can be overlapped and attached such that the flaps are interleaved. Glue, staples, tape or other attachments can be employed. Not all the flaps need to be attached together. For example the front and rear opposite flaps can be attached, whereas the side wall flaps are simply rested internally against the attached flaps.

In order to achieve a one piece construction and a center divider panel, Sheffer '276 employs a wide bottom flap attached to the front side wall panel (i.e., the wall panel which has the tear-out perforations, and two half-width bottom flaps attached to the opposite wall panel (i.e., the rear wall panel). The rear wall panel is formed by two half-width segments that are glued or otherwise affixed to one another for closing the box into a collapsed tube. One of the rear wall segments is the proximal portion of a length of sheet material that continues from the proximal segment around a right angle fold into a distal panel extending from the attachment at the rear wall to the front wall of the carton. This distal panel is glued to the back side of the front wall and provides the central vertical web that subdivides the carton into two compartments. Each compartment has a front wall access opening extending up to the top edge of the front wall.

Accordingly, the '276 Sheffer carton provides, in a one-piece blank, a full width front wall panel with openings extending to the top edge of the front wall panel. The front wall panel is attached at vertical folds to two end wall panels, in turn attached at vertical folds to two half-width rear wall panels, one of which is further attached at a vertical fold to the compartment partitioning panel. Each of the wall panels, except for the partitioning panel, has an associated top flap and bottom flap in the flat blank, which flaps form the top and bottom closures. Not all the top and bottom panels are attached at folds to the immediately adjacent wall panel. In order to fold the top flaps into a U_shaped configuration to cover the front wall access openings, some of the top panels are attached to adjacent flaps instead of to the adjacent wall panel, whereby the top flaps can cover the top and also fold down over the front and rear of the carton.

It is known to provide boxes with bottom panels that engage together to lock an erected box in a rectilinear configuration without the need for tape, glue, tabs or the like. For example, four flaps on a rectilinear container can be interleaved such that each flap rests over one flap adjacent to it on one side, and under the flap adjacent to it on the other side. The interleaved flaps thereby hold each other in place in a plane. In boxes having simple rectangular flaps, achieving this interleaved state is difficult using two hands because all four flaps must be positioned for interleaving while pressing them commonly inwardly. In U.S. Pat. No. 3,517,875—Wakefield, flaps protrude from the bottom of the front, rear and two side walls of a box and are arranged to lock in a complementary manner, with complementary shapes rather than rectangular shapes. When the flaps are folded inwardly downward in the proper order from inside the box, two opposite flaps partly overlap each other. The two remaining flaps are interleaved with the first two, and stop the lapped opposite flaps from passing the plane of the end. The four flaps are thus unfoldable to form a closed end or bottom that is interlocked to reside in the end plane without additional attachment means. However, the flaps can be pushed inwardly if the box is empty.

It would be advantageous to employ interlocking bottom flaps in a carton such as that of the Sheffer '276 patent, which can be assembled easily and locks the bottom flaps against any movement from the bottom plane. In addition, there is another problem to be addressed. Whereas two access openings or cutouts are provided in the front wall panel opening into the internal compartments, the front panel is relatively weak against collapse due to vertical forces. The strength of the carton against vertical forces (e.g., produced by stacking filled boxes in a display) is not fully corrected by the compartment subdividing panel because the front panel lacks a lateral connection between the end walls in the area of the cutouts, where the subdividing web is affixed. Thus the subdividing web can be bent or diverted toward either of the access openings without substantial resistance.

The access openings can be removed by the initial die cutting operation on the flat blank, or perforated and removable by a retailer after the packer fills the interior compartments with product. Whereas the top flaps associated with the front panel overlie the from panel, the access openings are preferably removed initially and closed by the overlying flaps. Nevertheless, when the overlying flaps and/or perforated access openings are laid open, the front central portion of the carton is relatively unsupported.

It would be advantageous if a collapsible carton blank could be formed in a manner that would better support the compartment subdividing web at the front, which would interlock readily at the bottom without requiring substantial effort, and which could be cut from a single integral flat sheet.

SUMMARY OF THE INVENTION

It is an object of the invention to make a subdivided packing and shipping carton from an integral flat piece of corrugated paperboard or the like, with a conveniently closable interengaging bottom structure.

It is also an object to brace a carton against vertical forces, especially a carton otherwise weakened by front sidewall access openings, by providing a reinforced central web subdividing the carton in a manner that can be folded flat.

It is a another object to provide a self erecting carton as described, wherein interengaging bottom flaps are provided with an insert tongue having a slot for locking reinforcing portions of the central web, the tongue also locking the interengaging bottom flaps.

These and other aspects and objects are provided according to the invention in a reinforced carton cut from a single sheet of material to form exterior wall panels, bottom flaps and an internal subdividing web, attached to one another at vertical folds such that the carton can be collapsed flat for shipping. The bottom flaps engage with one another when the carton is erected into a rectilinear state, and at least one tongue flap extends from one of the bottom flaps for insertion between the bottom flaps when assembled. The tongue flap extends into the interior and is slotted to receive a lower edge of the internal web. The internal web includes a first panel attached to the front and rear wall panels, in particular at a fold at the rear and a glue tab at the front. At least one reinforcing panel, and preferably two reinforcing panels, are foldably attached along the edges of the first panel. The reinforcing panels fold up and/or down to rest against the first panel. The tongue can have lateral locking edges, and the slot in the tongue is wide enough to receive the folded over internal web panels. The central web extends between the front to rear walls to subdivide the carton laterally, and access openings extend up to the top edge of the front wall on either side of the central web. Thus the central web reinforces the carton against vertical forces, e.g., due to stacking, even though the access openings are such that the point of attachment between the central web and the front wall is separated from the side walls by the access openings. The access openings can be closed by top flaps that are folded over them in a U-shaped configuration and are removable for use of the canon as a dispensing display.

An advantageous aspect of this carton is that the carton is cut and formed from an integral piece of flat stock, such as corrugated paperboard or the like. Thus all the panels, including the foldably attached bottom flaps as well as the partition, reinforcement panels and side wall panels, are attached to one another. The carton can have a separable cover or cap, but preferably has top flaps, also cut from the integral sheet, that fold over the top as well as the front panel, to seal over the access openings.

Although the front panel has only a very limited width vertical strip between the access openings, each of which extends to the top edge of the front panel, the reinforcing panel(s) and central web are attached to this strip and strengthen the carton, especially against vertical forces that could otherwise deform the vertical strip and/or the central web. This central web and its reinforcement are locked in place by the slotted tongue, which can have lateral locking edges such that the tongue locks into the interengaging bottom flaps, thereby keeping the tongue in engagement with the central web and reinforcing panels, and also causing the slotted tongue to extend upward slightly into the interior of the canon.

The carton is readily cut from the integral sheet material and folded and glued at vertical glue strips along the rear wall and at the attachment of the central web to the vertical strip at the front wall. In this state the carton can be collapsed flat between diagonally opposite comers. Prior to packing with product the carton is erected into a rectilinear shape to provide a bifurcated rectangular tube. The reinforcing panels are then folded against the central web panel and the bottom flaps are folded inwardly, the last being the slotted tongue panel, which locks the bottom in place without the need for glue or fasteners.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
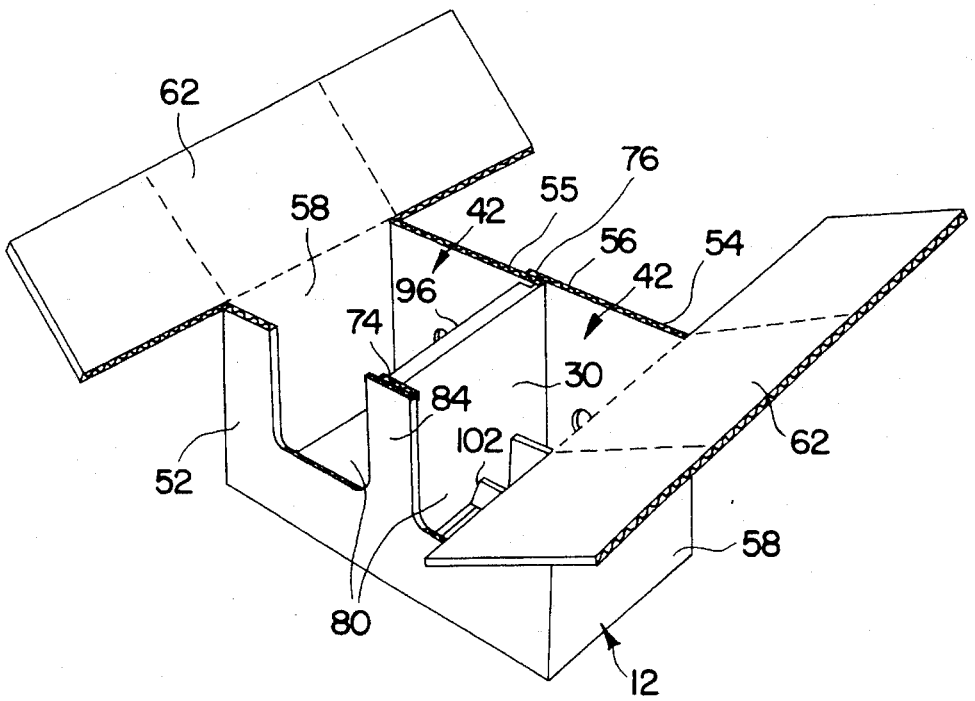
FIG. 1 is a perspective view of a two-compartment, one-piece, shipping and retail-display canon according to the invention, shown erected and in the open state, ready to be loaded with product.

FIG. 1 shows a two-compartment, one-piece shipping and retail display carton 12 according to the invention, erected and open as ready for packing. Carton 12 in the open state defines a rectilinear box shape having horizontal bottom flaps, a vertical web or partition 30 dividing carton 12 laterally into two compartments 42, and four vertical side walls 52, 54, 58. The side walls typically are vertical when the carton is deployed for loading and/or retail display. However, the carton can be oriented and/or deployed otherwise. Accordingly, terms such as "horizontal,"0 "vertical," "top," "bottom," "upper," "lower," "left," "right," "length," "width" and so on, are used herein only for convenience as relative expressions and are not intended to limit the respective panels and/or carton 12 to any particular orientation.

In FIG. 1, the central web or partition 30 is three folded-over thicknesses of material, a fold at the top edge being visible. Side walls 52, 54, 58 and top flaps 62 are a single thickness except along certain narrow glue strips as explained below. The bottom flaps (not shown in FIG. 1 ) are also of a single thickness, but the bottom flaps overlap one another in places so as to interengage and hold one another substantially in the plane of the bottom of carton 12.

Figure 2:
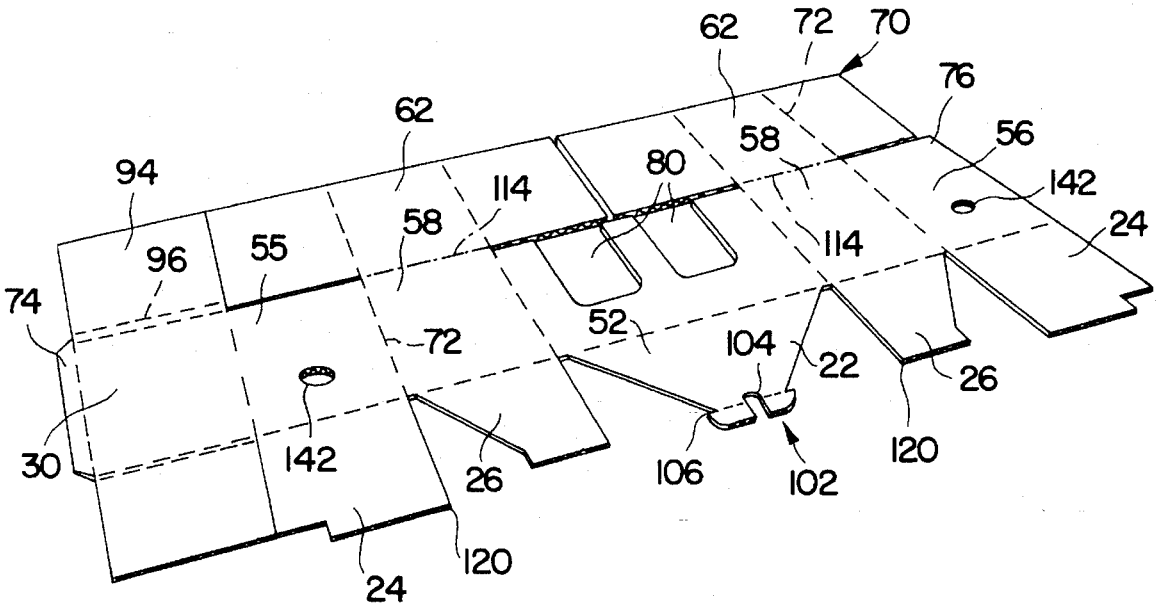
FIG. 2 is a perspective view of the carton shown in FIG. 1, laid out flat as cut from an integral piece of sheet material, foldable lines being shown as broken lines and cuts being shown in solid lines.

FIG. 2 shows the blank 70 of single thickness material that is to be folded and assembled into the carton of FIG. 1. The respective panels of carton are thus laid flat, being cut from an integral piece of sheet stock such as corrugated paperboard or the like. Referring to both FIGS. 1 and 2, carton 12 includes five panels that are foldably attached to one another along fold lines 72 to form the four side walls. The rear side wall 54 is formed of two lengths 55, 56 of material. One length 55 is folded forwardly at 90° at the center rear of carton 12 to provide a partial width of the back wall 54 as well as the central reinforced web panel 30, which is attached at a distal strip 74 by a glue joint to the back side of front panel 52. The front panel is full width. The other partial-width rear panel 56 overlaps the other panel 55 of back wall 54 along another strip 76 that is glued.

The various fold lines can be creased, perforated or similarly weakened portions of the sheet. The fold lines 72 between the respective wall panels 54, 55, 56, 58 and central web 30 are generally parallel and extend between upper edges and lower edges of the side wall panels, where the panels are attached at horizontal folds to the top and bottom flaps. The fold lines between end walls 58 and top flaps 62 can be deeply scored, perforated, etc., such that the top flaps are easily removed by a retailer when opening the carton.

Figure 3:
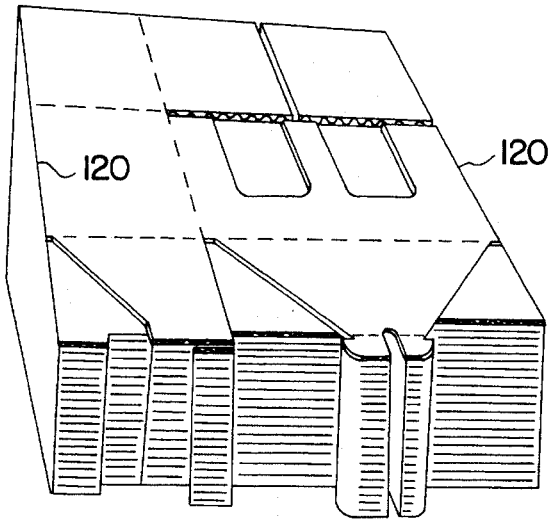
FIG. 3 is a perspective view of a stack of cut blanks as in FIG. 2, preliminarily glued to provide bifurcated tube blanks collapsed between diagonally opposite corners.

The wall panels are coplanar in FIG. 2, but are intended to be provided with glue joints and collapsed into the shape of flattened bifurcated robes such that they can be stacked for shipping as shown in FIG. 3, then erected and assembled as shown in FIG. 1 before packing.

Comparing FIGS. 1 and 2, panel 52 defines the full width from side wall of carton 12. From panel 52 is flanked by opposite end panels 58, which define the left and right side walls. Flanking left and right side wall panels 58 are two remaining panels 55, 56 that together define the back side wall 54. Further panel 30 is attached to one back side wall half length panel 55, and defines the partition in the carton that extends across the open interior, preferably centered and parallel to left and right side wall panels 58. The partition can be placed off centered, if desired, and additional partitions or other structures can be included or inserted, as known in the art.

The glue strip or tab portion 74 at the extreme end of central web or partition 30 is foldable to a right angle for abutting against the back side of front side wall 52 at the strip between access openings 80. Two access openings 80 are provided as shown, for use of the carton as a dispensing display. Preferably the access openings occupy a substantial proportion of the area of from panel 52, thereby leaving a relatively thin strip 84 that is separated from end side walls 58 along the top of canon 12 because the access openings extend to the top edge of the from wall. It is an aspect of the invention that the central web 30 can be reinforced by one or two reinforcing panels 92, 94 that extend upwardly and downwardly from web 30 in the flat blank as shown in FIG. 2. The reinforcing panels 92, 94 are foldable along horizontal fold lines at the top and/or bottom edge of central web 30, to rest against the panel or portion of central web 30 that is glued to the back side of from panel 52. Preferably, one reinforcing panel 92 is folded upwardly directly against central web 30 and a second reinforcing panel 94 is folded downwardly around a wide or double crease 96 to wrap over and enclose the upwardly folded panel 92 together with the central web portion 30. The reinforcing panel structure is shown in detail in FIGS. 5 and 7, discussed below.

Figure 6:
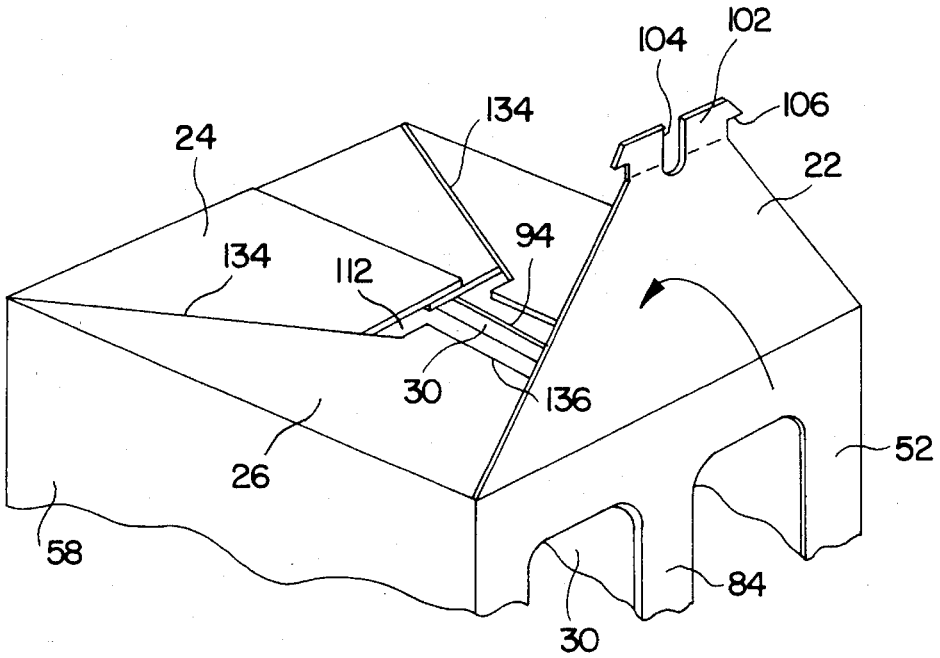
FIG. 6 is a partial perspective view showing initial assembly of the interengaging bottom panels, namely all but the final locking panel.
Figure 7:
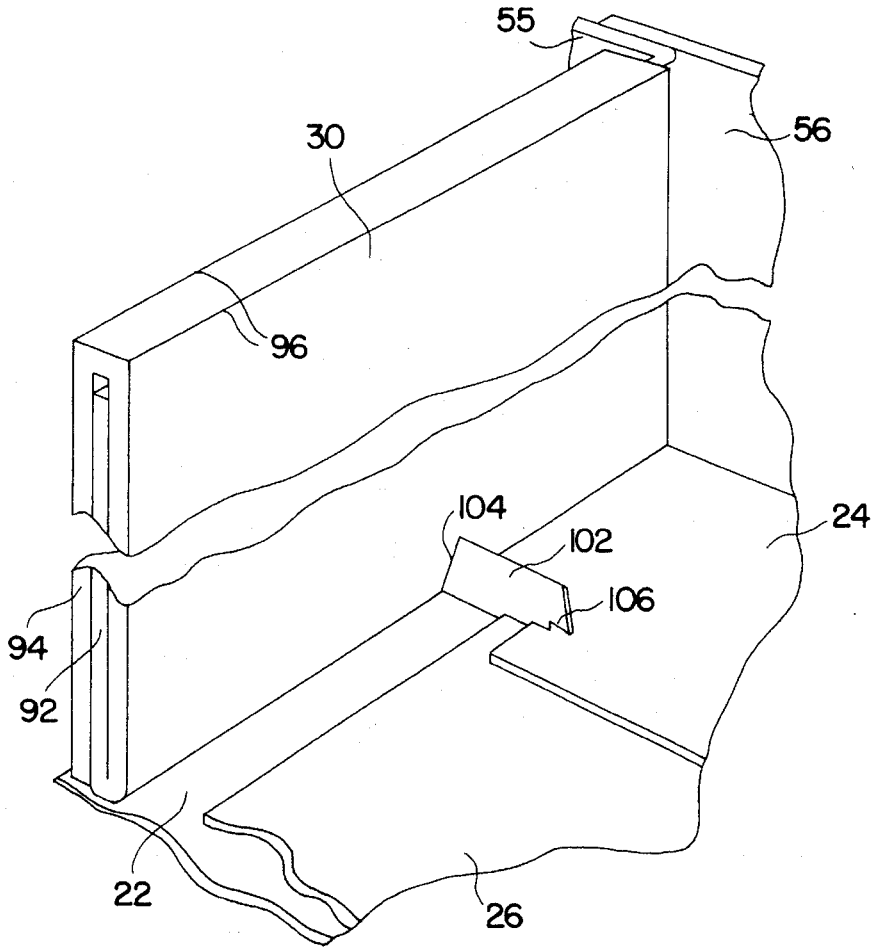
FIG. 7 is a cutaway perspective view, partly cut away, showing the engagement of the slotted tongue and the central web from within the carton.

It is a further aspect of the invention that the bottom of the carton has an interlocking flap structure in which one of the bottom flaps 24 has a protruding tongue part 102, with a slot 104 forming a receptacle that snugly receives and stabilizes central web 30, including reinforcing panels 92, 94. The tongue part 102 preferably is generally barb shaped and has locking edges 106, and fits into a gap 112 defined between the others of the bottom flaps 22, 26, thus locking the bottom flaps in an interengaging manner without the need for glue, tape, staples or the like. The multiple thickness reinforced central web 30 and its engagement with the bottom flap locking structure, forms a rigid and stable carton that can withstand forces applied in use of the carton, such as vertical and lateral forces applied at the central strip 84 between access openings 80 at the front of carton 12. The locking tab structure is best shown in FIGS. 6 and 7, and is likewise discussed hereinafter in detail.

The carton can also include top flaps 62 that fold over access openings 80 as in U.S. Pat. No. 5,413,276—Sheffer, the disclosure of which is hereby incorporated in its entirety. Alternatively, other forms of top structures such as a separable cover or cap (not shown) can be used to close the top of carton 12 and preferably to seal over access openings 80. Alternatively or in addition, the access openings can have perforated panels that remain in place during packing and shipping, and are removed by the retailer when deploying the carton for display. In the embodiment shown, the top closure flaps 62 are arranged to extend over the top, front and rear of carton 12 in a U-shape, and are readily removable, for example by providing score lines or perforations 114 attaching top flaps 62 to side walls 58, shown in dash-dot lines in FIG. 2, whereas at other fold lines the material is merely creased by compression or the like such that it folds readily but is not easily separated.

The flat blank 70 of FIG. 2 proceeds through a number of steps illustrated in FIGS. 3 through 9. It is customary in the packaging industry that different parties effect preliminary assembly in a knocked-down flat state; erection and further assembly, loading and closing for shipment; and finally opening, display and access to the product in the carton. The carton manufacturer cuts the flat blanks as in FIG. 2, and makes the glue joints needed to assemble collapsed rectangular tube shapes, bifurcated by central web 30. This can be accomplished by feeding cut blanks to a folding and gluing machine (not shown) that applies a curable or hardenable adhesive along the glue lines while folding the flat blank at diagonally opposite corners 120 as well as at front glue strip 74 and at the bend 122 between rear half panel 55 and central web 30. The blanks can remain flat as the adhesive hardens, stacked for shipment to the packer as shown in FIG. 3.

Figure 4:
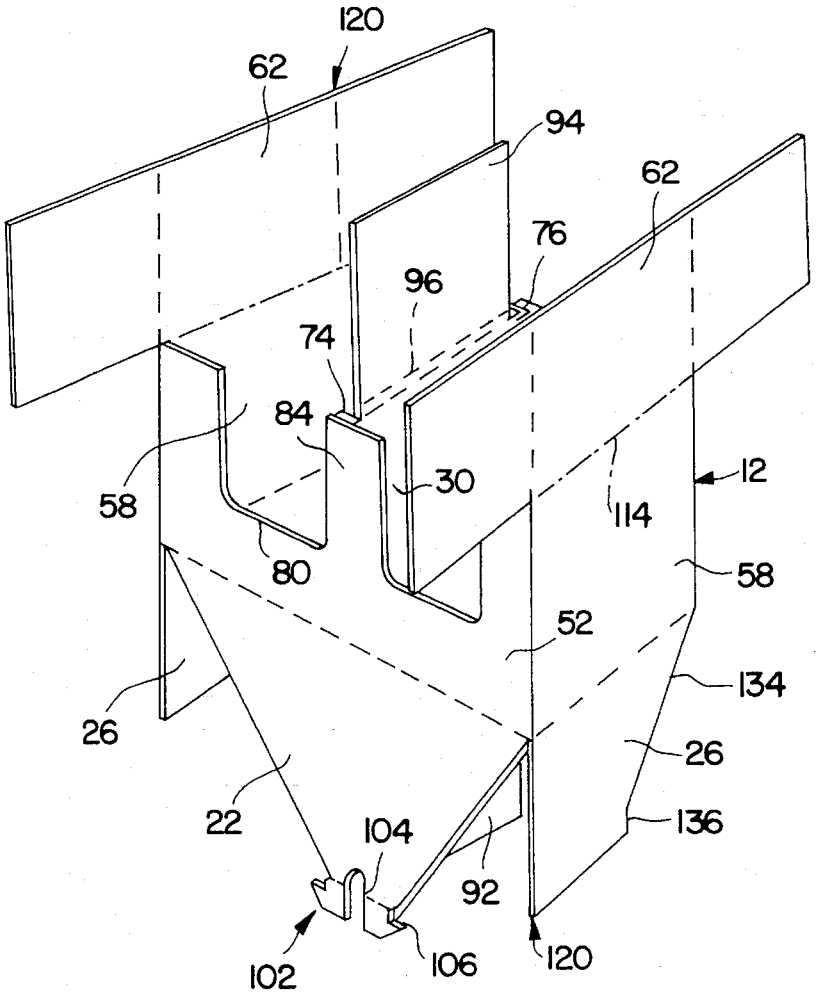
FIG. 4 is a perspective view of a blank as in FIG. 3, erected into a rectilinear shape.

FIGS. 4–9 show the erection and loading steps, typically accomplished by the packer. The packer generally unstacks one, carton from the stack, and erects it into the rectilinear shape shown in FIG. 4 by applying inward pressure between the diagonally opposite corners 120. As carton 12 is erected, bottom flaps 22, 24, 26, top flaps 62, and also the reinforcing panels and web 30, 92, 94, become coplanar with the side wall panels or the central web panel to which the respective flaps and reinforcing panels are attached as shown in FIG. 4. Central web 30 is then reinforced and the interengaging bottom flaps 22, 24, 26 are folded inwardly to provide mechanical engagement and support for carton 12.

Figure 5:
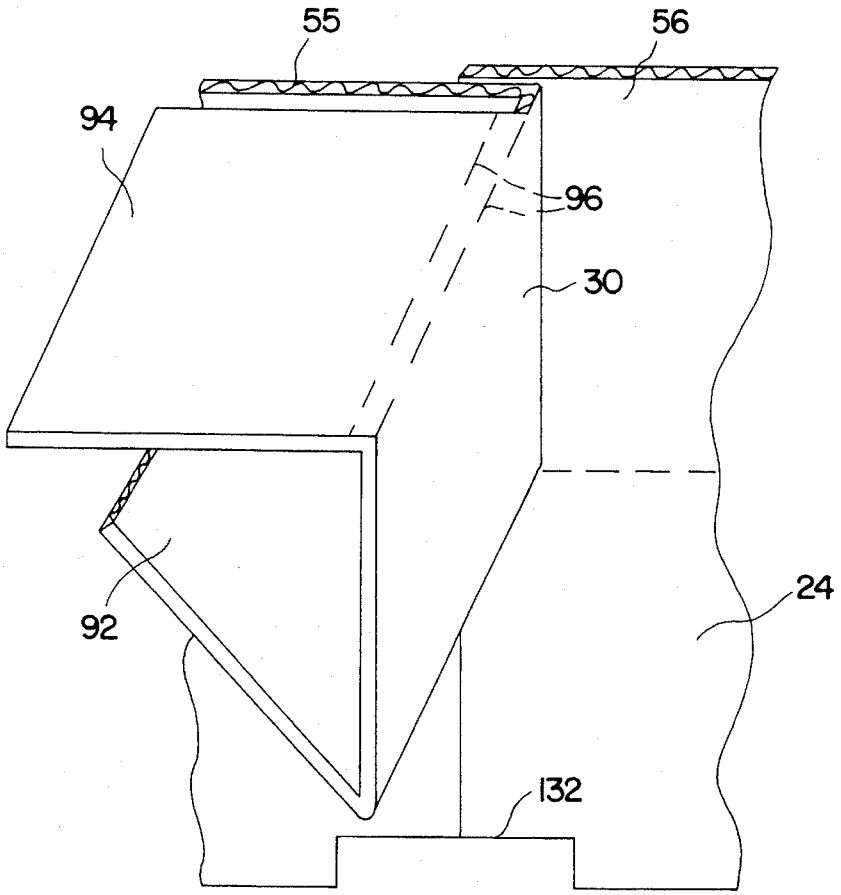
FIG. 5 is a sectional perspective view illustrating the step of reinforcing the central web by folding over two reinforcing panels, the front and end panels being cut away.

Referring to FIGS. 4 and 5, at least one reinforcing panel 92 is folded over to abut against the panel of central web 30 that extends between the right angle fold 122 at the rear (at the integral attachment to half panel 55) and the right angle fold at the front (at glue strip 74). Preferably the upper-extending reinforcing panel 94 in FIG. 4 is folded downwardly such that the free ends of web 30 and panel 94 can be captured in a structure at the bottom flaps 22, 24, 26. For additional rigidity and support against collapse from vertical pressure, in the embodiment shown a lower reinforcing panel 92 is first folded upwardly on a narrow crease or fold, and an upper reinforcing panel 94 is folded downwardly around and over the upwardly folded one, namely at a rounded fold or at a fold 96 having two fold lines spaced by twice the thickness of the material. Thus the exposed top edge of central web or partition 30 presents a fold and the bottom edge presents (toward the bottom) a fold against which flap 94 is rested to confine the upwardly folded reinforcing panel 92 between the glued web panel 30 and the downwardly folded reinforcing panel 94.

To assemble the interengaging bottom flaps, and also to lock together reinforcing panels 92, 94 and web 30, the bottom flaps 22, 24, 26 are folded inwardly as shown in FIG. 6. The first flap folded inwardly can be the rear panel flap 24 (which is formed by two half width portions that are overlapped and glued in the same manner as half width rear side wall panels 55, 56). The hall width flap panels together define a short rectangular cutout 132, best shown in FIG. 5 but also partly bounding the gap 112 between the bottom flaps in FIG. 6. Next, the end wall panel bottom flaps 26 are folded inwardly from either side to partly lap over rear bottom flap 24. The end wall panel bottom flaps 26 can have diagonal edges 134 so as not to provide unnecessary additional material under rear flap 24, which lines carton 12. The end wall panel flaps 26 also have rectangular extensions 136 positioned such that when end wall panel flaps 26 are lapped over rear flap 24 and its rectangular cutout 132, an open slot 112 remains for receiving locking tongue 102 on front bottom flap 22.

The locking tongue 102 protrudes from the distal end of the final bottom flap 22, foldably affixed to the front side wall panel 52. Whereas, when inserted, locking tongue 102 passes over the rectangular extensions 136 of end wall panel bottom flaps 26 and over the edge of the rectangular cutout 132 in rear panel bottom flap 24, the locking tongue 102 becomes inclined upwardly when inserted, and extends partly rearwardly and partly upwardly into the interior of carton 12, as shown in FIG. 7. The locking tongue 102 has lateral barb-like edges 106 that engage around the edges of rectangular gap or slot 112, 132, locking all four bottom flaps in the plane of the bottom by capturing extensions 136 of side wall bottom flaps 26 between front flap 22 and rear flap 24.

Furthermore, locking tongue 102 has a slot 104 that is dimensioned and positioned to straddle snugly around central web 30 and its folded over reinforcing panel(s) 92, 94. The locking tongue engagement with reinforced central web 30 and with the edges of the rectangular slot formed by the other bottom flaps is shown in FIG. 7. In the embodiment shown, having two reinforcing panels 92, 94 and one glued web forming central partition 30, the locking tongue slot 104 is as wide as three thicknesses of the sheet material. The locking tongue 102 thus holds the outer folded-down reinforcing panel 94 against the central web 30 and against the inner folded-up reinforcing panel 92 captured between the panels of sheet material.

The locking tongue in the embodiment shown is affixed to front panel flap 22. This arrangement is preferred because the front panel is cut in one piece rather than being formed from two half width panels that are glued together (as is the rear panel flap 24). Thus the tongue on the front flap is accurately cut out rather than varying from carton to carton as a function of the accuracy of the glue joint, which could affect the width of slot 104. However it is also possible to place the locking tongue on the rear bottom flap or generally to reverse the arrangement of the bottom structure.

Figure 8:
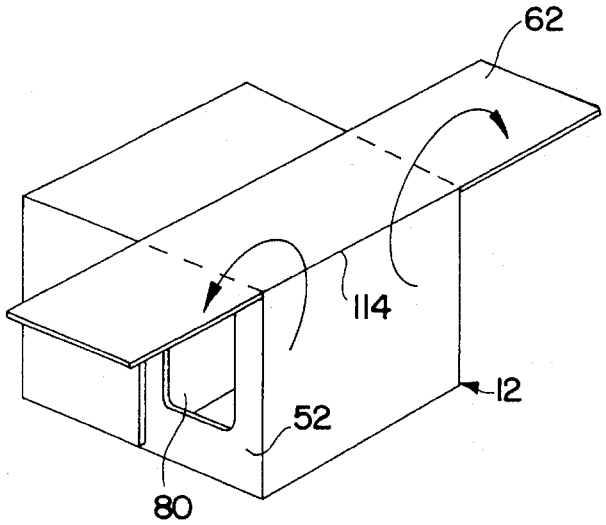
FIG. 8 is a perspective view showing attachment of the top closure flaps; and, FIG. 9 shows the carton with the closure flaps removed for use of the carton as a dispensing display container.

The assembled carton 12 can then be set upright as shown in FIG. 1 to be loaded with product. After loading, top closure flaps 62 are folded closed and attached as shown in FIG. 8. As discussed above, the reinforcing web and bottom flap locking structures can also be used with other top closure arrangements. Once the top flaps 62 or other closures are sealed, for example with adhesive tape, and the access openings 80 are closed over, the packed and closed carton 12 is ready for shipping, inventory storage or the like.

Figure 9:
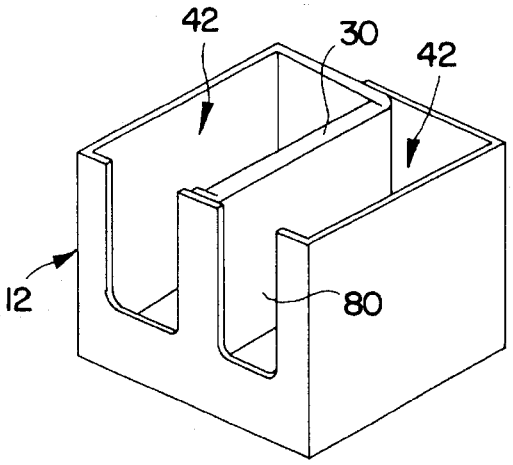

The retailer uses carton as a dispensing display of the product in a retail setting such as on a counter or retail shelf (not shown). As shown in FIG. 9, the retailer removes the top cover, for example removing closure flaps 80 and their flanges covering the top of the carton at perforations 114, or at least removes the front portions of the closures to uncover access openings 80, thereby deploying the carton for display and access to the product. Insofar as any product located below the bottom edge of access openings 80 may be difficult to remove manually, finger holes 142 as shown in FIGS. 1 and 2 in rear side wall 54 can be provided to assist in lifting the product such that it can be grasped. These holes 142 preferably are also covered by the top flaps 62 when carton 12 is sealed as in FIG. 8.

The reinforced, bottom-locked carton 12 is stable, substantially sealed, and is particular resistant to deformation of central web 30 and front panel strip 84 due to vertical forces, for example due to stacking the cartons or placing a weight on the cartons after they are opened. The carton is well apt when closed to meet the industry standard that similar classes of boxes should support 275 pounds (125 kilograms) of vertical weight, and even when opened can support a substantial proportion of that weight. A number of additional attributes and advantages should also be apparent from the foregoing description and the examples of preferred embodiments explained in detail.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A one-piece carton comprising:

a plurality of exterior wall panels attached to one another at parallel folds extending between upper and lower edges thereof such that the wall panels can be collapsed flat, the wall panels including a front panel, a rear panel and two side panels, an internal web attached at folds to two opposite ones of the exterior panels for subdividing an interior between the wall panels;

a plurality of bottom flaps extending from the lower edges of the exterior panels, at least one of said bottom flaps forming a tongue flap extending from one of said two opposite ones of the exterior panels and having an insertable tongue, the bottom flaps being arranged to interengage one another in a rectilinear erected state of the carton with the tongue inserted into the interior, the tongue being slotted to receive a lower edge of the internal web in the erected state for stabilizing the internal web.

2. The carton of claim 1, wherein the internal web comprises a first panel attached to said two opposite panels and at least one reinforcing panel attached to the first panel, the reinforcing panel being foldable against the first panel and the tongue being slotted to receive the first panel and the reinforcing panel.

3. The carton of claim 2, comprising two said reinforcing panels foldably attached to the first panel at opposite edges thereof, the two reinforcing panels being foldable against one another and against the first panel for providing plural layers of reinforcement to the internal web.

4. The carton of claim 1, wherein one of said two opposite panels is a front panel having at least two spaced access openings, and wherein the central web is attached to a rear side of the front panel between the access openings.

5. The carton of claim 4, wherein the access openings extend to a top edge of the front panel.

6. The carton of claim 2, wherein one of said two opposite panels is a front panel having at least two spaced access openings extending to a top edge of the front panel, and wherein the central web is attached to a rear side of the front panel between the access openings.

7. The carton of claim 6, further comprising a plurality of top flaps foldably attached to the upper edges of the wall panels, the top flaps being foldable over the access openings for sealing the carton and removable for use of the carton as a dispensing display carton.

8. A one-piece carton comprising:

a plurality of exterior wall panels attached to one another at parallel folds extending between upper and lower edges thereof such that the wall panels can be collapsed flat, the wall panels including a front panel, a rear panel and two side panels, an internal web attached at folds to two opposite ones of the exterior panels for subdividing an interior between the wall panels, the internal web having a first panel attached between a front and a rear one of the exterior panels and at least one reinforcing panel foldably attached along an edge of the first panel such that the reinforcing panel is foldable against the first panel; and, a plurality of bottom flaps extending from the lower edges of the exterior panels, at least one of said bottom flaps forming a receptacle for receiving the internal web.

9. The carton of claim 8, wherein the bottom flaps include at least one tongue flap extending from one of said two opposite ones of the exterior panels and having a slotted tongue insertable between the bottom flaps into an interior of the carton, the slotted tongue forming the receptacle.

10. The carton of claim 8, wherein the wall panels, the internal web, the at least one reinforcing panel and the bottom flaps are all formed from cut portions of an integral sheet material.

11. The carton of claim 10, comprising two said reinforcing panels foldably attached to the first panel at opposite edges thereof, the two reinforcing panels being foldable against one another and against the first panel for providing plural layers of reinforcement to the internal web.

12. The carton of claim 10, wherein the from panel has at least two spaced access openings, and wherein the central web is attached to a rear side of the front panel between the access openings.

13. The carton of claim 12, wherein the access openings extend to a top edge of the front panel.

14. The carton of claim 10, wherein one of said two opposite panels is a front panel having at least two spaced access openings extending to a top edge of the front panel, and wherein the central web is attached to a rear side of the front panel between the access openings.

15. The carton of claim 10, further comprising a plurality of top flaps foldably attached to the upper edges of the wall panels, the top flaps being foldable over the access openings for sealing the carton and removable for use of the carton as a dispensing display carton.

* * * * *

UNITED STATES PATENT AND TRADEMARK OFFICE

CERTIFICATE OF CORRECTION

PATENT NO. : 5,524,815
DATED : June 11, 1996
INVENTOR(S) : Phil B. Sheffer

It is certified that error appears in the above-indentified patent and that said Letters Patent is hereby corrected as shown below:

Column 1, line 12, delete "cannon" and substitute therefor --carton--.

Column 1, line 41, delete "cannon" and substitute therefor --carton--.

Column 4, line 63, delete "cannon" and substitute therefor --carton--.

Column 6, line 8, delete "robes" and substitute therefor --tubes--.

Column 6, line 12, delete "From"" and substitute therefor --Front--.

Column 6, line 20, delete "centered" and substitute therefor --center--.

Column 6, line 31, delete "cannon" and substitute therefor --carton--.

Column 6, line 32, delete "from" and substitute therefor --front--.

Column 6, line 39, delete "from" and substitute therefor --front--.

Signed and Sealed this

Eighteenth Day of March, 1997

*Attest:*

*Attesting Officer*

Bruce Lehman

BRUCE LEHMAN

*Commissioner of Patents and Trademarks*